US005325643A

United States Patent [19]

Mitchell et al.

[11] Patent Number: 5,325,643

[45] Date of Patent: Jul. 5, 1994

[54] SOIL RETAINER BLOCK

[76] Inventors: William F. Mitchell, 704 Canteberry Hill, San Antonio, Tex. 78209; Stan Motz, 265 Sandy Oaks, Seguin, Tex. 78155

[21] Appl. No.: 925,391

[22] Filed: Aug. 4, 1992

[51] Int. Cl.[5] ..... E02D 19/02; E02D 31/02

[52] U.S. Cl. ..... 52/169.1; 52/169.5

[58] Field of Search ..... 52/292, 169.1, 169.5, 52/169.9, 170, 305, 169.11; 405/284–287, 262

[56] References Cited

U.S. PATENT DOCUMENTS

| | | | |
|---|---|---|---|
| 975,665 | 11/1910 | Wemlinger | 405/284 |
| 3,654,765 | 4/1972 | Healy | 52/169.5 X |
| 3,754,362 | 8/1973 | Daimler | 52/169.5 |
| 3,888,087 | 6/1975 | Bergsland | 52/169.5 X |
| 4,045,964 | 9/1977 | Barclay | 52/169.5 X |
| 4,245,443 | 1/1981 | Beechen | 52/305 X |
| 4,538,387 | 9/1985 | Barnett | 52/169.5 |
| 4,574,541 | 3/1986 | Raidt | 52/169.5 |
| 4,590,721 | 5/1986 | Berg | 52/169.1 |
| 4,662,794 | 5/1987 | Delmas | 405/284 X |
| 4,704,048 | 11/1987 | Ahlgrimm | 52/169.5 X |
| 4,730,953 | 3/1988 | Taiko | 52/169.11 X |
| 4,840,515 | 6/1989 | Freese | 52/169.5 X |
| 4,956,951 | 9/1990 | Kannankeril | 52/169.5 |
| 5,035,095 | 7/1991 | Beilacqua | 52/169.5 |
| 5,044,821 | 9/1991 | Johnsen | 52/169.5 X |
| 5,107,642 | 4/1992 | Mogstao | 52/169.5 |
| 5,163,261 | 11/1992 | O'Neill | 52/594 X |

FOREIGN PATENT DOCUMENTS

| | | | |
|---|---|---|---|
| 2247906 | 3/1992 | United Kingdom | 405/284 |

*Primary Examiner*—Carl D. Friedman
*Assistant Examiner*—Beth A. Aubrey
*Attorney, Agent, or Firm*—Donald R. Comuzzi; Christopher L. Makay

[57] ABSTRACT

The present invention is a soil retainer block formed of lightweight, flexible, and durable material used to prevent soil and water from seeping under a foundation supported above the underlying soil by piers. In use, the present invention is placed about a foundation and then covered with top soil to form a barrier which prevents soil and water invasion. The present invention is constructed of the lightweight, flexible, and durable material in order to provide superior moisture resistance, impact resistance, and safe and easy installation.

4 Claims, 1 Drawing Sheet

SOIL RETAINER BLOCK

BACKGROUND OF THE INVENTION

The present invention relates to soil retainer blocks used in building construction. More particularly, but not by way of limitation, the present invention is a flexible, lightweight, and durable soil retainer block used to prevent soil and water from seeping underneath a building foundation.

In many areas of the country, buildings, either commercial or private, are constructed with their foundations supported above the ground by concrete piers interconnected by crossbeams to prevent soil movement from damaging the foundation. Some soils, especially those containing clay, tend to be very moisture sensitive which means that they expand and contract responsive to the amount of water in the soil. The constantly expanding and contracting soil creates shearing forces which often cause foundations resting directly on the soil to crack. Thus, foundations placed on concrete piers are protected from the underlying soil. However, once a foundation has been raised, it is necessary to prevent soil and moisture from invading the space separating the foundation from the underlying soil.

The conventional method employs concrete soil retainer blocks placed against and about the foundation. Soil is then filled about the foundation to remove the concrete blocks from view. Thus, the concrete blocks form a barrier which attempts to prevent soil and water from accumulating under the foundation. The concrete retainer blocks operate adequately to keep out soil and moisture, however, builders and building owners experience problems when using them.

Concrete soil retainer blocks are difficult to install. Expensive placement machinery is necessary to aid in their placement, and they are fairly heavy, weighing approximately 70 lbs, which makes them difficult to situate against each other and the foundation. Additionally, their weight creates an increased risk of lifting injuries to the workers installing them. Essentially, the heavy concrete soil retainer blocks require extensive machinery, manpower, and time to install which makes them uneconomical as well as potentially injurious.

Furthermore, once in place, the concrete soil retainer blocks do not adequately stop soil and water from invading the space underneath the foundation. Although the concrete soil retainer blocks abut against the foundation and each other, they fail to form a perfect seal because of their inflexible construction. Instead, grouting must be placed at all the seals. Unfortunately, grouting is rather brittle when it dries and easily cracks which creates openings through which soil and water may pass. Additionally, applying the grouting about the concrete soil retainer blocks is expensive when measured in both time and labor. Moreover, the top edges of the concrete soil retainer blocks form a ledge which traps water against the foundation. The trapped water then seeps under the foundation to cause moisture damage.

Thus, the present invention has been designed as a lightweight, flexible, and durable soil retainer block which overcomes the above problems and functions more efficiently to prevent soil and moisture from invading the space underneath the foundation.

SUMMARY OF THE INVENTION

The present invention is a soil retainer block fabricated from a lightweight, flexible, and durable material (high density polyethylene in the preferred embodiment) which offers significant advantages over conventional concrete soil retainer blocks. The lightweight and flexible design of the soil retainer blocks of the present invention makes installation extremely easy. Expensive placement machinery is eliminated and lifting injuries are avoided. Furthermore, the material used to fabricate the soil retainer blocks cuts easily which permits their sizing to any length, thereby, allowing a form fit about the foundation. Essentially, the soil retainer blocks of the present invention may be installed faster, more safely, and at a lower cost than conventional concrete soil retainer blocks.

Additionally, although flexible, the soil retainer blocks of the present invention utilize a special tapered rib design that provides a tensile strength far greater than that of concrete. Thus, the flexibility and strength of the soil retainer blocks of the present invention permit a tight seal to be formed against the foundation which almost completely eliminates soil and water seepage. A further advantage of increased flexibility and tensile strength is that soil compaction equipment may be used directly adjacent to the soil retainer blocks without damage. To aid in forming a tight seal, the soil retainer blocks of the present invention are provided with edges about all their sides. The lower edges of the soil retainer blocks are placed in a groove dug in the soil about the foundation in order to contribute stability to the blocks as they rest against the foundation. The upper edges of the soil retainer blocks lay flush against the foundation and form a tight seal created as a result of pressure exerted on them by the soil used to secure the building crawl space. The side edges of adjacent soil retainer blocks are overlapped to again form a tight seal created through top soil pressure. Furthermore, the soil retainer blocks of the present invention have a tapered design which functions to shed water from the blocks and allow free drainage of the water away from the foundation. Hence, the tight seal and tapered structure of the soil retainer blocks of the present invention prevent soil and water from seeping into the space immediately underneath the foundation.

It, therefore, is an object of the present invention to produce a lightweight and durable soil retainer block which has superior moisture resistance, flexibility, impact resistance, and may be safely and easily installed.

Still other features and advantages of the present invention will become evident to those skilled in the art in light of the following.

DETAILED DESCRIPTION OF THE PREFERRED EMBODIMENT

Figure 1:
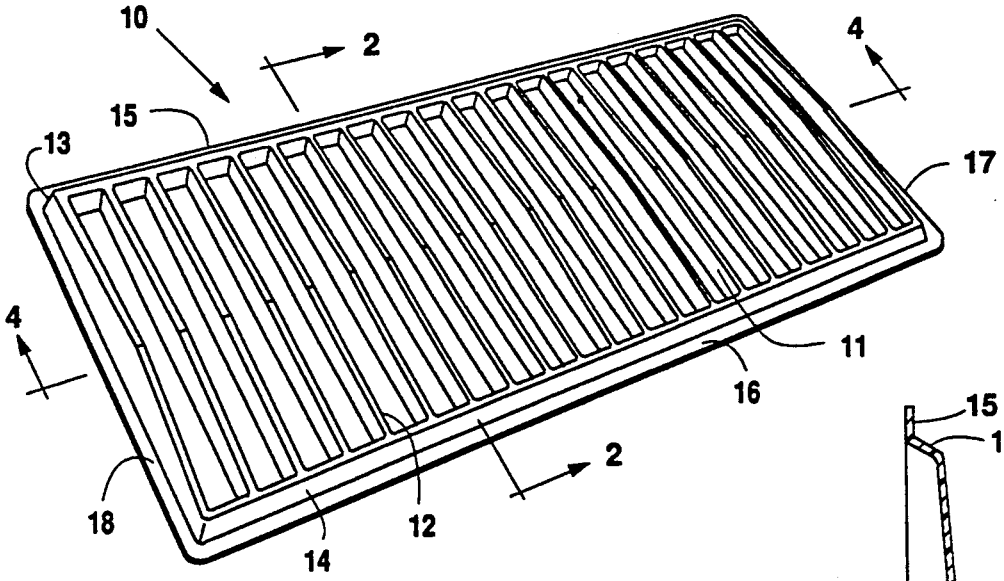
FIG. 1 is a perspective view of the soil retainer block according to the preferred embodiment of the present invention.
Figure 2:
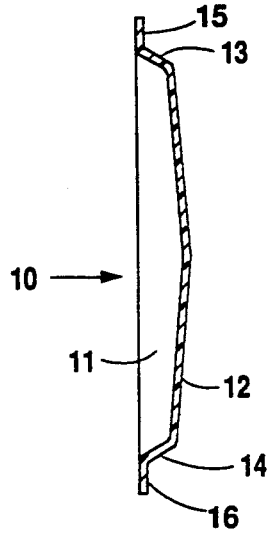
FIG. 2 is a side view of the soil retainer block according to the preferred embodiment of the present invention.
Figure 4:
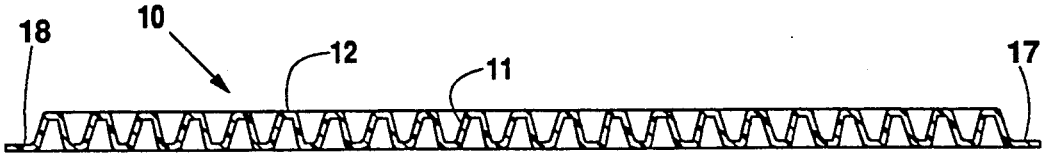
FIG. 4 is a cross-sectional view showing the tapered rib construction of the soil retainer block according to the preferred embodiment of the present invention.

Referring to FIGS. 1, 2, and 4, the soil retainer block according to the preferred embodiment of the present invention will be described. Soil retainer block 10 comprises a quadrilateral fabricated from a lightweight, flexible, and durable material (high density polyethylene in the preferred embodiment) using any conventional molding process. The front face of soil retainer block 10 comprises front face portion 11 and raised reinforcing ribs 12 extending from face portion 11 (see FIG. 4). Raised reinforcing ribs 12 are tapered and serve to increase the tensile strength of retainer block 10 which creates a higher breaking stress. Ledges 13 and 14 (See FIG. 2) interconnect raised reinforcing ribs 12 and are angled to allow for the free drainage of water from soil retainer block 10. Furthermore, edges 15 and 16 are formed integrally with ledges 13 and 14, respectively, and edges 17 and 18 are formed integrally with edges 15 and 16 and the ends of face portion 11 to permit the placement of block 10 over the opening between the ground and a suspended; pier-supported building foundation to prevent to prevent backfill soil from entering the space underneath the suspended, pier-supported building foundation.

Figure 3:
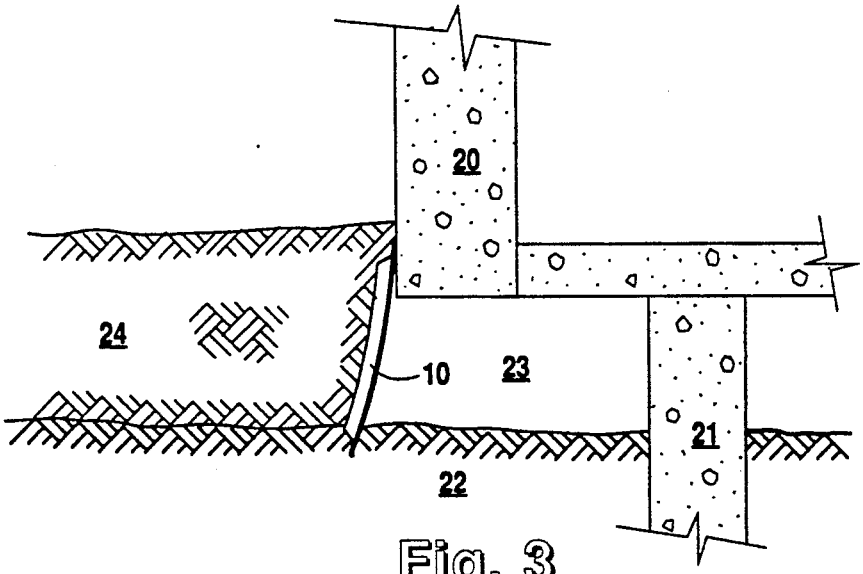
FIG. 3 is a side view showing the installation of a soil retainer block of the present invention about a foundation.

Referring to FIG. 3, the use of the retainer blocks of the present invention to keep soil and water from underneath a building foundation will be described. Foundation 20 is supported above soil 22 by pier 21 and numerous others ( not shown ) . Space 23 created between soil 22 and foundation 20 by the piers must remain free from soil to prevent undo stress from being exerted upon foundation 20, possibly causing foundation 20 to crack. To prevent soil and water from seeping into space 23, soil retainer block 10 and many other identical ones are placed about foundation 20. For installation, a small trench is dug about foundation 20 and either edge 15 or 16 of retainer block 10 is placed into the trench. The opposite one of edges 15 or 16 is then placed flush against foundation 20. Additional soil retainer blocks are then placed adjacent the first one with their side edges 17 or 18 overlapping. Once all the soil retainer blocks are in place, soil 24 is placed about foundation 20 in order to cover the soil retainer blocks and hold them in place utilizing the pressure exerted by the weight of soil 24. After soil 24 has been added, the pressure exerted against the soil retainer blocks creates a seal between the edges of the soil retainer blocks and foundation 20 and also between the overlapped side edges. Thus, the present invention requires no mechanical interlocking means to secure them together. In addition, the tight seal formed as a result of the soil pressure creates an almost impenetrable barrier which prevents soil and water from seeping under foundation 20. The present invention, therefore, provides a most effective method of precluding soil and water invasion of the space underneath a foundation supported by piers.

From the foregoing description and illustration of this invention, it should be apparent that various modifications can be made by reconfigurations or combinations to produce similar results. It is, therefore, the desire of the Applicants not to be bound by the description of this invention as contained in this specification, but to be bound only by the claims as appended hereto.

We claim:

1. A soil retaining apparatus, comprising:

a block constructed from a lightweight, high density material adapted to be positioned over the opening between the ground and a suspended, pier supported building foundation to prevent backfill soil from entering the space underneath the suspended, pier supported building foundation, said block, comprising:

a front face portion, a plurality of raised reinforcing ribs extending from said face portion, first and second angled ledges interconnecting said raised reinforcing ribs, and a first edge formed integrally with and extending from said first angled ledge and a second edge formed integrally with and extending from said second angled ledge to anchor said block in the ground and against the suspended, pier-supported building foundation to cover the opening between the ground and the suspended, pier supported building foundation to prevent backfill soil from entering the space underneath the suspended, pier-supported building foundation.

2. The apparatus according to claim 1, said block being quadrilaterally shaped and formed from a high density polyethylene material.

3. The soil retaining apparatus according to claim 1 further comprising a third edge formed integrally with said first and second edges and extending from one end of said front face portion and a fourth edge formed integrally with said first and second edges and extending from an opposite end of said front face portion to permit the overlapping of a plurality of said blocks to form a barrier over the opening between the ground and the suspended, pier supported building foundation to prevent backfill soil from entering the space underneath the suspended, pier-supported building foundation.

4. The soil retaining apparatus according to claim 1 wherein said raised reinforcing ribs are tapered to increase the tensile strength of said block.

* * * * *